US006761004B2

(12) United States Patent
Anglin et al.

(10) Patent No.: US 6,761,004 B2
(45) Date of Patent: Jul. 13, 2004

(54) RECONFIGURABLE ROOM PARTITIONING SYSTEM

(75) Inventors: Todd Anglin, Van Alstyne, TX (US); Carroll Moore, Oakland, CA (US); Erez Steinberg, Oakland, CA (US)

(73) Assignee: Affordable Building Systems, Whitewright, TX (US)

( * ) Notice: Subject to any disclaimer, the term of this patent is extended or adjusted under 35 U.S.C. 154(b) by 0 days.

(21) Appl. No.: 10/136,892

(22) Filed: May 2, 2002

(65) Prior Publication Data

US 2003/0205010 A1 Nov. 6, 2003

(51) Int. Cl.[7] ..... E04B 2/00

(52) U.S. Cl. ..... 52/238.1; 52/239; 52/241; 52/242; 52/243

(58) Field of Search ..... 52/239, 241, 242, 52/204.1, 205, 206, 210, 408, 459, 782.1, 234, 238, 236.6, 236.7, 238.1, 240, 243, 243.1; 312/242, 245; 160/45, 87, 127, 371

(56) References Cited

U.S. PATENT DOCUMENTS

| | | | | | |
|---|---|---|---|---|---|
| 2,159,296 | A | * | 5/1939 | sharp | 52/27 |
| 3,160,246 | A | * | 12/1964 | Donlon | 52/481.2 |
| 3,205,630 | A | * | 9/1965 | Felix et al. | 52/476 |
| 3,228,160 | A | * | 1/1966 | O'Brien | 52/242 |
| 3,593,473 | A | * | 7/1971 | King | 52/211 |
| 3,593,475 | A | * | 7/1971 | LaGue | 52/241 |
| 3,699,734 | A | * | 10/1972 | Craig et al. | 52/127.6 |
| 3,755,978 | A | * | 9/1973 | Jackson | 52/127.7 |
| 4,030,260 | A | * | 6/1977 | Sukolics et al. | 52/204.591 |
| 4,245,442 | A | * | 1/1981 | Durham | 52/126.4 |
| 4,266,387 | A | * | 5/1981 | Karlsson | 52/731.3 |
| 4,356,672 | A | * | 11/1982 | Beckman et al. | 52/36.6 |
| 4,361,994 | A | * | 12/1982 | Carver | 52/238.1 |
| 4,603,531 | A | * | 8/1986 | Nash | 52/793.1 |
| 4,821,476 | A | * | 4/1989 | Thoburn et al. | 52/238.1 |
| 4,852,317 | A | * | 8/1989 | Schiavello et al. | 52/239 |
| 4,856,253 | A | * | 8/1989 | Jou | 52/718.05 |
| 4,887,401 | A | * | 12/1989 | Gioscia | 174/48 |
| 4,914,879 | A | * | 4/1990 | Goldberg | 52/242 |
| 5,010,702 | A | * | 4/1991 | Daw et al. | 52/241 |
| 5,037,596 | A | * | 8/1991 | Bowen et al. | 264/184 |
| 5,062,246 | A | * | 11/1991 | Sykes | 52/126.4 |
| 5,140,792 | A | * | 8/1992 | Daw et al. | 52/238.1 |
| 5,152,113 | A | * | 10/1992 | Guddas | 52/238.1 |
| 5,274,975 | A | * | 1/1994 | Haag | 52/300 |
| 5,305,567 | A | * | 4/1994 | Wittler | 52/238.1 |
| 5,644,877 | A | * | 7/1997 | Wood | 52/241 |
| 5,875,596 | A | * | 3/1999 | Muller | 52/239 |
| 6,141,925 | A | * | 11/2000 | Halvorson et al. | 52/238.1 |
| 6,202,382 | B1 | * | 3/2001 | Conterno | 52/762 |
| 6,279,278 | B1 | * | 8/2001 | Morris et al. | 52/239 |
| 6,338,227 | B1 | * | 1/2002 | Finke | 52/207 |
| 6,393,782 | B1 | * | 5/2002 | Berridge et al. | 52/239 |
| 6,634,149 | B2 | * | 10/2003 | Cates et al. | 52/283 |

* cited by examiner

*Primary Examiner*—Jeanette Chapman
(74) *Attorney, Agent, or Firm*—Robert W. Brown; Robert H. Frantz

(57) ABSTRACT

A reconfigurable office partition system that includes movable rigid panels each comprised of a core panel mounted within a perimeter frame. Said core panel comprised of a matrix of compressed straw or other cellulose-based natural fiber lined by paper or paperboard suitable for accepting a variety of surface treatments, and also suitable for accepting nails, screws or other means for hanging or otherwise attaching articles thereon. Frames comprised of vertical and horizontal rails specially adapted to engage said core panels and further adapted to releasably and slidably attach to a series of specialty connectors.

18 Claims, 17 Drawing Sheets

RECONFIGURABLE ROOM PARTITIONING SYSTEM

TECHNICAL FIELD OF THE INVENTION

This invention relates to the fields of room partitioning components, and especially to interconnection systems and devices for moveable and reconfigurable partitioning panel systems.

CROSS-REFERENCE TO RELATED APPLICATIONS

Not applicable.

FEDERALLY SPONSORED RESEARCH AND DEVELOPMENT STATEMENT

This invention was not developed in conjunction with any Federally sponsored contract.

MICROFICHE APPENDIX

Not applicable.

INCORPORATION BY REFERENCE

Not Applicable.

BACKGROUND OF THE INVENTION

In modern office buildings, business and conference centers, hotels, classrooms, medical facilities, and the like, the fitting-out of occupiable space is continuously becoming more important and ever more challenging. In the competitive business environment, cost concerns alone dictate the efficient use of interior space. Thus, the finishing or fitting-out of building spaces for offices and other areas where work is conducted has become a very important aspect of effective space planning and layout.

Business organizations, their work patterns and the technology utilized therein are constantly evolving and changing. Building space users require products that provide for change at minimal cost. At the same time, their need for functional interior accommodations remains steadfast. Issues of privacy, functionality, aesthetics, acoustics, etc., are unwavering. For architects and designers, space planning for both the short and long term is a dynamic and increasingly challenging problem. Changing work processes and the technology required demand that designs and installation be able to support and anticipate change.

Space allocation and planning challenges are largely driven by the fact that modern office spaces are becoming increasingly more complicated due to changing and increasing needs of users for more and improved utilities support at each workstation or work setting. These utilities encompass all types of resources that may be used to support or service a worker, such as communications and data used with computers and other types of data processors, telecommunications, electronic displays, etc., electrical power, conditioned water, and physical accommodations, such as lighting, HVAC, sprinklers, security, sound masking, and the like. For example, modern offices for highly skilled "knowledge workers" such as engineers, accountants, stock brokers, computer programmers, etc., are typically provided with multiple pieces of very specialized computer and communications equipment that are capable of processing information from numerous local and remote data resources to assist in solving complex problems. Such equipment has very stringent power and signal requirements, and must quickly and efficiently interface with related equipment at both adjacent and remote locations. Work areas with readily controllable lighting, HVAC, sound masking, and other physical support systems, are also highly desirable to maximize worker creativity and productivity. Many other types of high technology equipment and facilities are also presently being developed which will need to be accommodated in the work places of the future. Moreover, the office space layout of these "knowledge workers" changes frequently to accommodate new technology, or to accommodate changing work teams resulting from changing business objectives, changing corporate cultures, or a combination thereof.

Office workers today need flexible alternative products that provide for the obtainment of numerous, often seemingly conflicting objectives. For example, the cultural aims of an organization may require the creation of both individual and collaborative spaces, while providing a "sense of place" for the users, and providing a competitive edge for the developer. Their needs include a range of privacy options, from fully enclosed offices which support individual creative work to open spaces for collaborative team work. At the same time, their products must be able to accommodate diverse organizations, unique layout designs, and dynamic work processes.

Further compounding the challenge are the overall objectives to promote productivity, minimize the expenses of absenteeism and workman's compensation, and reduce potential liability. Meeting these objectives often requires improved lighting, better air quality, life safety, and ergonomic task support.

As previously mentioned, for primarily cost reasons, The efficient use of building floor space is also an ever-growing concern, particularly as building costs continue to escalate. Thus, open office plans that reduce overall office costs are commonplace, and generally incorporate large, open floor spaces. These spaces are often equipped with modular furniture systems that are readily reconfigurable to accommodate the ever-changing needs of specific users, as well as the divergent requirements of different tenants.

An arrangement commonly used for open space office plans includes movable partial height partition panels that are detachably interconnected to partition off the open spaces into individual work settings and/or offices. These panels are typically configured to receive furniture units, such as work surfaces, overhead cabinets, shelves, etc., that hang from a framework. Another common arrangement involves dividing and/or partitioning open plans using of modular furniture, in which a plurality of differently shaped, complementary free-standing furniture units are positioned in a side-by-side relationship, with upstanding partial height privacy screens attached to selected furniture units to create individual, distinct work settings and/or offices. These types of modular furniture systems are considered readily reconfigurable and are easily moved to new sites, and are generally not part of a permanent leasehold improvement. Both of these arrangements typically incorporate panels that are largely hollow and usually comprised of a skeletal framework that support two face panels and some sort of edge plates on the top, bottom and sides.

Further, these arrangements most commonly include partial height partitions or dividers as opposed to full height walls spanning from ceiling to floor. No two office spaces are exactly alike. Floor to ceiling height, location of structural members, permanent walls, and utility and HVAC plenums vary from location to location. Thus, space-dividing systems must be adaptable to accommodate these variables. Furthermore, accommodating the varied requirements of office workers within a given facility may require a combination of fall and partial height dividers to provide a range of privacy levels corresponding to an individual user's job functions.

Historically, office walls or partitions are made by erecting a wood frame, lining each side with gypsum board (sheet rock) panels, then finishing the wall surfaces with a variety of textures and paint. These conventional walls have proven sturdy, provide adequate superior privacy and sound proofing, and provide a surface that easily accepts wall hangings such as pictures, paintings, plaques and the like. Furthermore, as is commonly known, conventional walls can easily be repainted, retextured, and, readily patched and repaired when damaged. However, conventional gypsum board partitions are typically custom built floor-to-ceiling installations, which do not adequately address many of the needs of the ever changing high-tech "knowledge worker." The need for increased utilities and partial height partitions have both proven to be needs that conventional gypsum board partitions fail to adequately address.

Conversely, presently available full and partial height architectural walls or partitions that are readily reconfigurable, have very little in common with gypsum board walls. Typically, they are comprised of hollow panels built around a metal frame, and are manufactured with a fixed surface such as cloth or other textured material attached to the surface. Consequently, finished walls are generally lightweight and have a less sturdy feel than gypsum walls. Furthermore, finished walls have a surface finish that is not readily replaceable or changeable and does not provide for hanging pictures, paintings, plaques and the like on a comparable basis to gypsum walls. These characteristics provide for walls that fail to meet some of the needs of the ever changing office tenants discussed supra.

Partition systems do exist that are designed to incorporate substantially solid panels, and can conceivably be used with compressed straw panels, but these systems possess many shortfalls when compared to subject invention. Most notably is the Ortech partition system disclosed herein. It is designed only for floor to ceiling applications and does not provide for the vertical disposal of utility wiring between panels. Additionally, the Ortech system does not provide a frame that is substantially flush with each panel face thereby providing for a substantially flat wall with a plurality of vertical utility plenums therein.

Therefore, what is needed in the art is an interior space-dividing system that provides the flexibility and reconfigurability of currently available partition systems while also providing the sturdiness, sound proofing, ease of resurfacing, and compatibility with conventional wall hangings provided by conventional gypsum board walls. Further, the need exists for a system that provides the versatility of full height and partial height application wherein vertical and horizontal utility plenums are numerous and closely spaced. The invention disclosed herein meets these needs, provides a system that is made primarily of recycled materials, and represents a significant improvement over existing art.

SUMMARY OF THE INVENTION

The present invention relates to the finishing or fitting-out of various types of interior building space such as offices, hotels, conference centers, business centers, meeting rooms, medical facilities, classrooms, etc. Particularly, the present invention provides for the finishing out of open interior space using an integrated partition system suitable for finishing-out said open space in a customizable and subsequently reconfigurable manner. Said partition system further provides for the use of solid core prefabricated panels held within rails that provide for a perimeter framework for the solid core panels, with said rails providing a network of conduits suitable for holding utility wiring there through.

The present invention discloses a modular office partition system based upon solid core panels comprised of a matrix of compressed straw lined on all sides by paper or paperboard. The compressed straw is arranged in layers with the straw fibers substantially parallel in orientation extending transversely across the panel from side to side when the panel is in a normal in-use orientation. Subject solid core panels are typically rectangular in shape, and typically will be oriented such that the longer edges are substantially vertical and the shorter edges are substantially horizontal. In this orientation, said straw fibers will be assume a generally horizontal orientation. Said solid core panels are suitable for securely accepting nails, tacks, screws and other connecting means for attaching and/or hanging items from the panel surfaces. Further, surfaces of solid core panels are suitable for accepting surface texture, paint, wall paper, and other conventional wall coverings. Additionally, said solid core panels possess sound insulating properties (disclosed herein) superior to both conventional gypsum board walls and many currently available commercial interior partition systems. Solid core panels further provide fire resistant properties superior to materials used in many presently available interior partition systems. To enhance flexibility, solid core panels can be cut and formed in the field using conventional tools such as circular, saber or band saws, routers, planers, sanders and the like. Ideally, however, a given partition system will be designed so that field alteration of solid core panels is minimized. In a preferred embodiment, solid core panels such as those manufactured by Affordable Building Systems of Texas are utilized.

Though the partition system disclosed herein includes a number of individual components, the system is designed around a compressed straw core panel. Said straw core panel is composed of highly compressed straw, usually wheat, rice, oat, or other recovered agricultural straw. Typically, panels are made through a dry extrusion process wherein straw is compressed into a substantially flat continuous web, normally between 1" is and 3" thick and between 30" and 65" wide. The continuous web is lined on all sides by paper or paperboard. The continuous web is then cut into rectangular panels of various lengths.

These straw core panels possess many unique properties highly suitable for partition system applications. For example, finished panels can easily be textured, painted, retextured, repainted, or covered with a variety of wall covering materials such as wallpaper or fabric comparably to conventional gypsum board walls or partitions.

Like conventional gypsum board or wood-based walls or partitions, straw core panels are suitable for accepting nails, tacks, screws or the like for hanging pictures, plaques, etc. As indicated by nail pull values listed herein, straw core panels possess nail pull properties superior to conventional gypsum board walls. Additionally, straw core panels are typically thicker and stronger, thus providing nails, screws, or the like driven therein support more weight than if driven into gypsum board.

Importantly, what is lacking in the art is a system suitable for effectively utilizing these straw core panels in a versatile modular office partition type system that is easily reconfigurable. Though these straw core panels possess many characteristics arguably ideal for interior partitions, existing partition systems either do not provide for incorporation of said straw core panels, or are limited in their application.

The system disclosed herein provides for the assembly of modular solid core partition panels. Said partition panels may be comprised of either a single solid core panel, a plurality of solid core panels, or transparent panel or any combination thereof with panels situated in edge to edge planar relation and held within a perimeter frame. Said perimeter frame includes horizontal and vertical rail assemblies that securely engage said solid core or glass panel(s) along the entire perimeter of said partition panel. Horizontal and vertical rail assemblies are further designed to releasably engage a plurality of connectors that provide secure edge to edge attachment of finished partition panels. Connectors further provide for partition panels to be easily connected in a parallel (planar), or perpendicular relationship there between. Also included and disclosed herein are various foot, crown and cover pieces that provide hollow interior axial space along perimeter frames that provides a conduit for utility wiring. Thus, utility wiring can be routed around the perimeter of finished partition panels. Further, rail assemblies, connectors, and associated pieces are designed to provide a continuous conduit through joint areas where partition panels edges are joined.

Size of finished partition panels can easily be varied to provide partial height or full height (floor to ceiling) partitions. Finished partition panel size can be changed either by the number of solid core panels included or by changing the length of the solid core panels. Partition panels can be erected as dividers or walls within open office space, or can be installed to cover permanent interior or structural walls to provide a consistent look and design throughout the entire interior space to be finished.

The present invention further provides for core panels that can be specially sized, either at the manufacturing plant or in the field, to provide doors, odd sized panels, transitional areas, etc., that are aesthetically and structurally consistent with partition is panels and provide a uniform "finished" look upon completion.

The features and advantages of the invention will be further understood and appreciated by those skilled in the art by reference to the following written specification, claims, and appended drawings.

BRIEF DESCRIPTION OF THE DRAWINGS

The figures presented herein when taken in conjunction with the written disclosure form a complete description of the invention.

FIGS. 10*a* through 10*c* show horizontal sectional views of vertical partition connections including two straw core panels, two transparent panels, and two straw core panels with a door member in between.

DETAILED DESCRIPTION OF THE INVENTION

The detailed description will begin with a figure by figure view of the individual components and sub-components of subject partition system. This process will familiarize the reader with each individual component prior to viewing various interaction and interconnection therebetween.

FIGS. 1 through 4 inclusive, are all cross sectional views of individual components that typically take a linear form perpendicular to the cross section illustrated. Further, the length of each component can vary as needed. In a preferred embodiment of subject invention, the individual components detailed in FIGS. 1 through 4 are made of extruded aluminum, aluminum alloy, or other extrudable material of sufficient strength and stiffness.

Figure 1A:
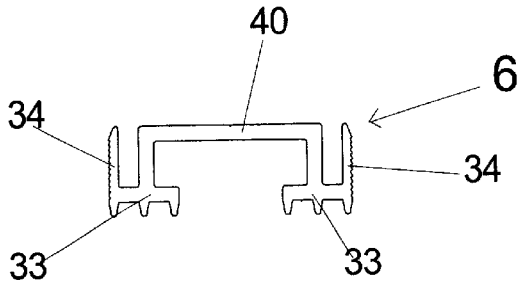
FIGS. 1*a* through 1*f* show individual sectional views of partition systems components; floor rail, ceiling crown, profile rail, and double 'T' connector, single 'T' connector, and crown rail respectively.
Figure 1B:
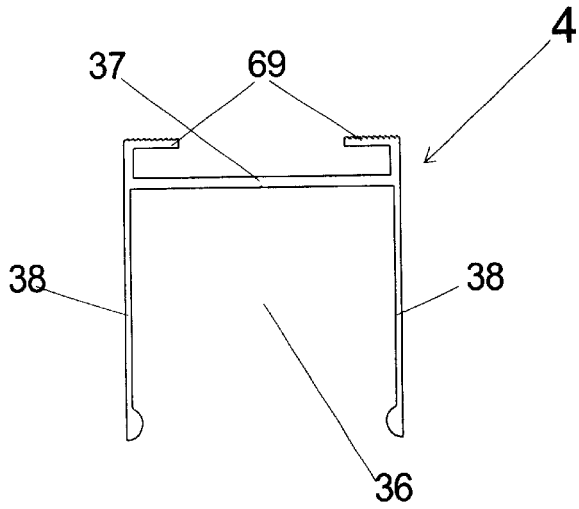
Figure 1C:
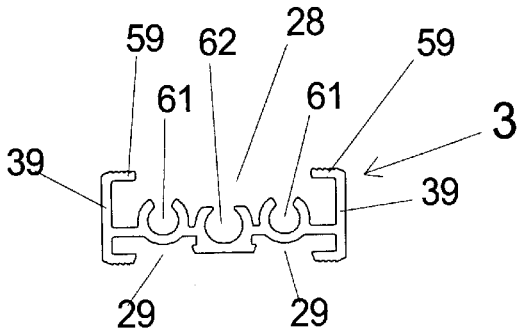

Referring first to FIG. 1*c*, an individual cross section view of a standard profile rail (3) is shown. As illustrated, profile rail (3) has a general 'C' channel cross sectional shape with two parallel shallow channels (29) on one side, and a larger open channel (28) opposite. On the inside of said open channel, opposite the opening are three substantially cylindrical openings. The two lateral openings are cap screw receivers (61), and the center cylindrical opening is a base leg receiver (62). The sides of profile rail (3) are defined by two side rails (39), with each side rail having an inwardly protruding retention rail (59) attached thereto. In this view, the top to bottom depth of open channel (28) is defined by retention rails (59) and cap screw receivers (61), and the inside width of open channel (28) is defined by side rails (39). As will be seen later in this disclosure, the inside dimensions of open channel (28) are sized to receive other components slidably therein.

Referring now to FIG. 1*a*, an individual cross section view of a floor rail (6) is shown. Each floor rail (6) comprising two foot pieces (33), two mounting rails (34) and a single internal frame (40) there between.

FIG. 1*b* shows and individual cross section view of a ceiling crown (4) comprised of a crown top (37) and two crown walls (38) collectively defining internal crown channel (36). Above crown top (37) are situated two contact rails (69) each situated to provide a contact with a ceiling located above.

Figure 1D:
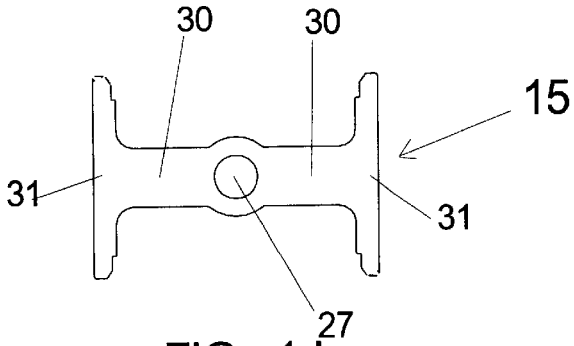
Figure 1E:
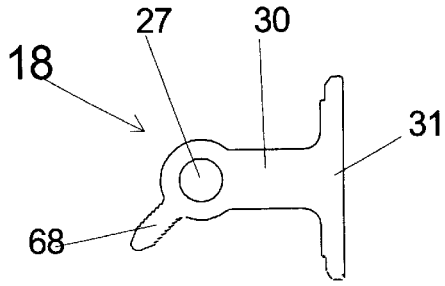

FIGS. 1*d* & 1*e* show individual cross section views of double 'T' connector (15) and single 'T' connector (18).

Each connector includes a cylindrical connector pin receiver (27), connector spines (30), and connector insert bars (31). Said insert bars (31) are sized to slidably fit within the open channels (28) of profile rails (3) discussed supra. Each single 'T' connector (18) includes a retention finger (68) designed to engage outside corner cover (19) detailed below.

Figure 1F:
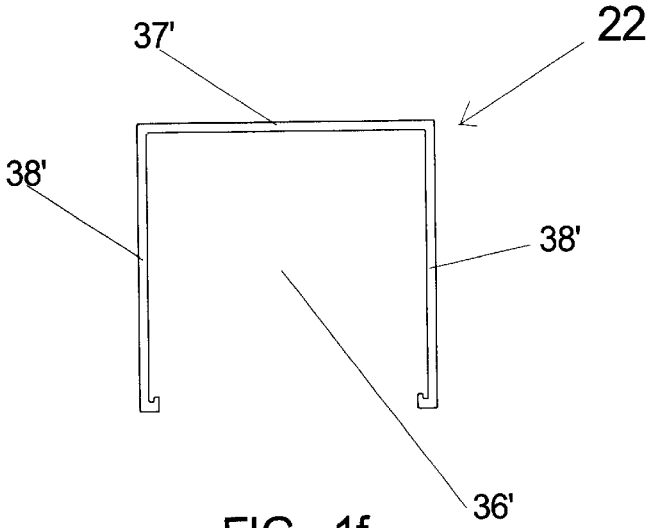

Finally, FIG. 1*f* shows an individual cross section of crown rail (22). Crown rail (22) provides an alternative for ceiling crown (4) in applications where a partial height partition in preferred and also includes crown walls (38) and crown top (37).

Figure 2A:
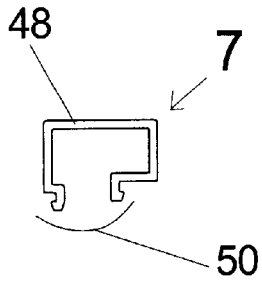
FIGS. 2*a* through 2*e* show individual sectional views of partition system components; window stop, covered window stop, vertical door rail, horizontal door rail, and base leg assembly respectively.
Figure 2B:
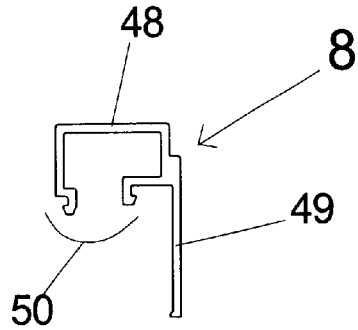
Figure 2C:
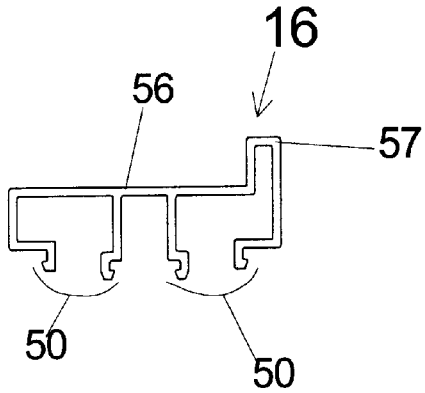
Figure 2D:
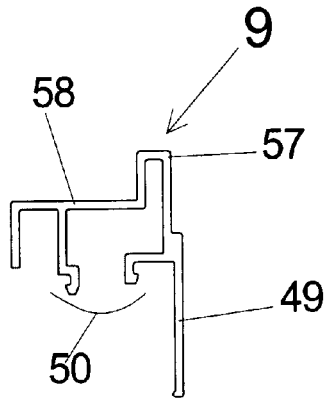

Several of the components included herein are designed to fixably attach to profile rail (3). These components are shown in FIGS. 2(*a–d*). Referring first to FIG. 2*a*, a cross section view of a window stop (7) is shown. Each window stop (7) includes a substantially rectangular channel member (48) and a standard clip connector (50). Further, FIG. 2*b* shows a cross section view of a covered window stop (8). Each covered window stop (8) includes a substantially rectangular channel member (48), and standard clip connector (50) and a cover member (49). Continuing, FIG. 2*c* shows a cross section view of horizontal door rail (16) including full face plate (56), door stop member (57) and two standard clip connectors (50). FIG. 2*d* shows a cross section view of vertical door rail (9) including half face plate (58), door stop member (57), cover member (49), and standard clip connector (50).

Figure 2E:
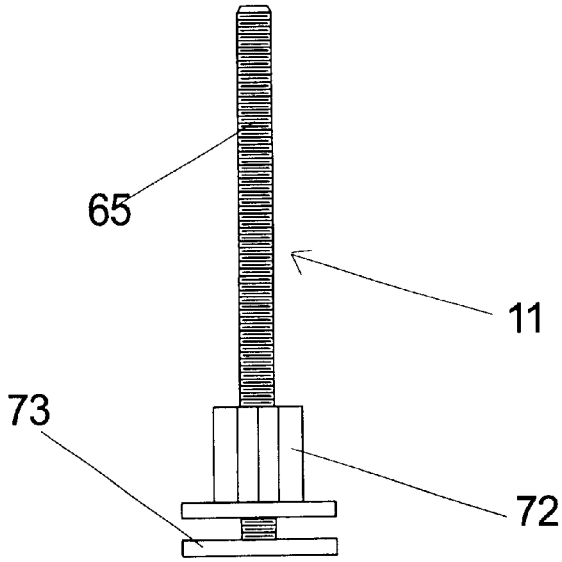

Referring now to FIG. 2*e* which shows a cross sectional view of base leg (11). Each base leg member includes threaded shaft (65), adjustment nut (72) and foot piece (73). Threaded shaft (65) being designed to fit firmly into base leg receiver (62) of profile rail (3), and adjustment nut (72) designed to rest on internal frame member (40) of floor rail (6).

Figure 4A:
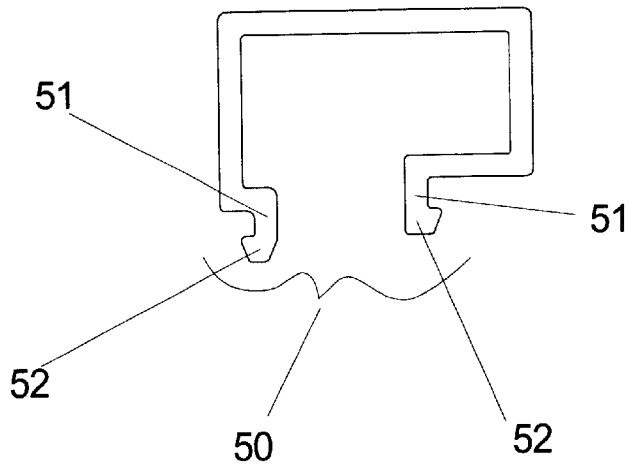
FIGS. 4*a* through 4*c* provide a cross sectional detailed views of the standard clip connector and standard clip receiver, and the sub-components therein.
Figure 4B:
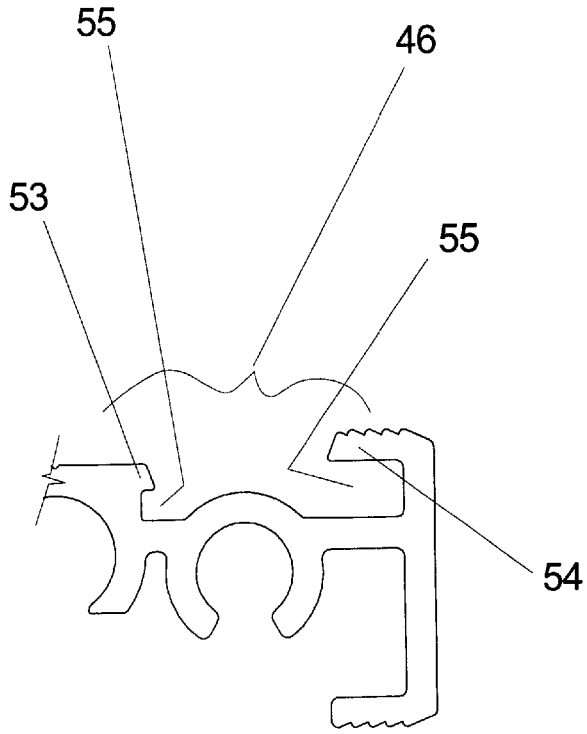

To illustrate the designed interconnection between components in the preferred embodiment, FIGS. 4(*a–c*) provides detailed views of standard clip connector (50) and standard clip receiver (46). As shown in FIG. 4*a*, the sub-components of standard clip connector (50) include two substantially parallel insert legs (51), each with a retention tooth (52) at the end facing outward. Individual components are design to allow insert legs (51) to elastically bend slightly inward. FIG. 4*b*, further shows the sub-components of standard clip receiver (46) that include a short retention foot (53), an opposed long retention foot (54) and two internal spaces (55) located adjacent to each. The distance between the end of short retention foot (53) and long retention foot (54) is designed to allow insertion of parallel insert legs (51) there between.

Figure 4C:
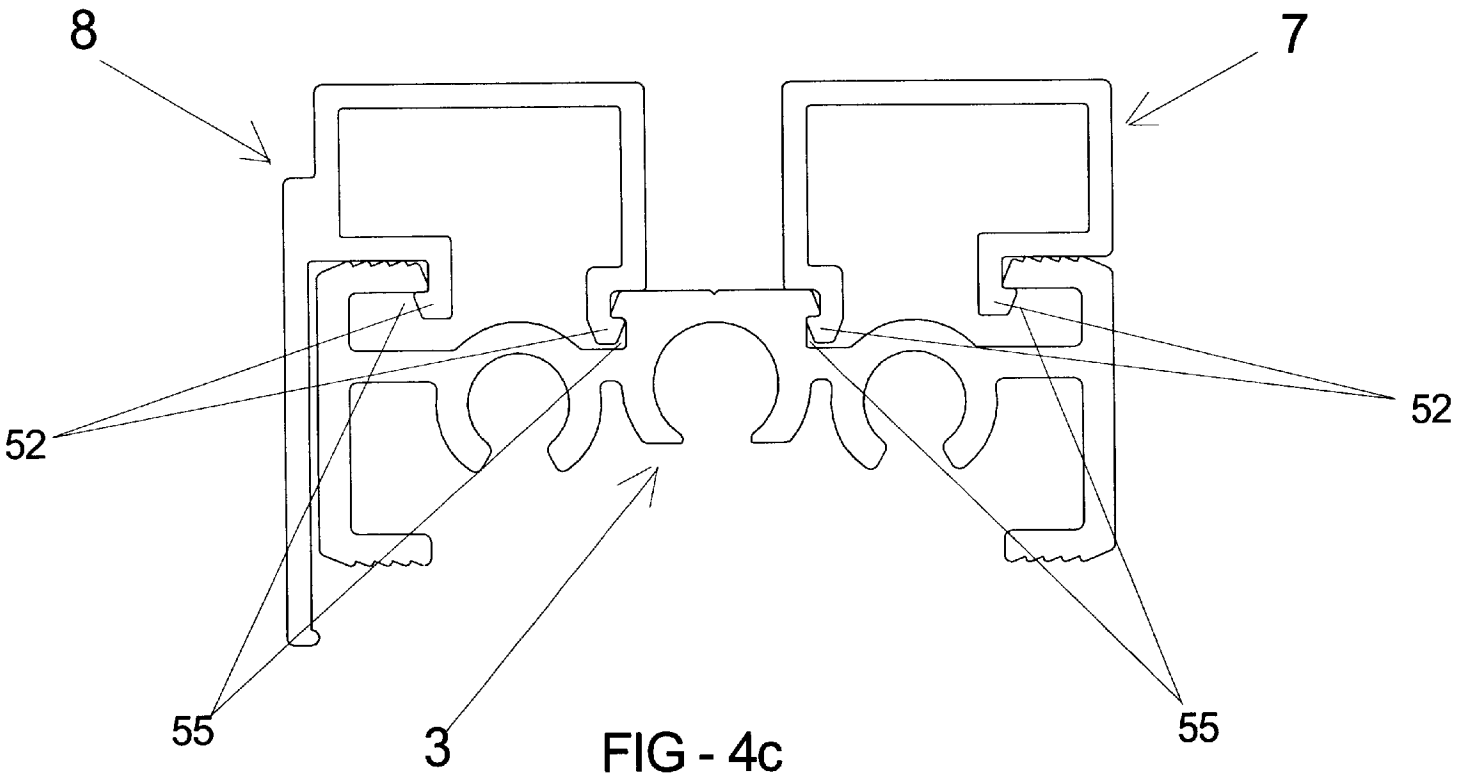

Continuing, FIG. 4*c* shows individual sectional views of components, window stop (7), covered window stop (8) and profile rail (3) with standard clip connectors (50) and standard clip receivers (46) properly joined. Insertion of opposed insert legs (51) through the gap between short retention foot (53) and long retention foot (54) requires the slight elastic displacement of both insert legs (51) inward. Upon complete insertion, insert legs (51) return to original position pushing each retention tooth (52) into respective spaces (55), thus locking components into position. With the exception of the compressed straw panels, all components disclosed herein are preferably made from extruded aluminum or aluminum alloy. These materials provide for individual components that possess sufficient elasticity to be interlocked as described above.

Figure 3A:
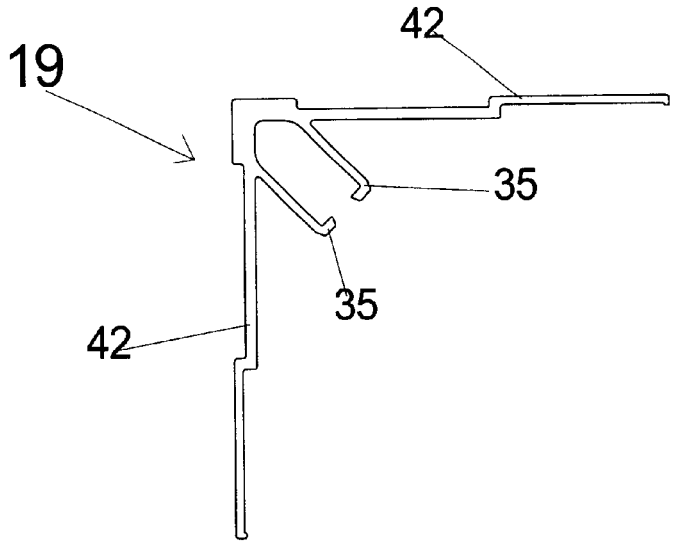
FIGS. 3*a* through 3*d* show individual sectional views of partition system components; outside corner cover, inside corner cover, base plate, and joint cover plate respectively.

Referring now to FIG. 3, wherein FIG. 3*a* shows a cross section view of an outside corner cover (19), with two cover plates (42) arranged in substantially perpendicular respective orientation and defining a right angle. Each corner plate (42) includes an opposed pair of retainer clips (35) directed inward substantially 45 degrees to said corner plates (42). Said retainer clips (35) are designed to engage a retention finger (68) on single 'T' connector (18).

Figure 3B:
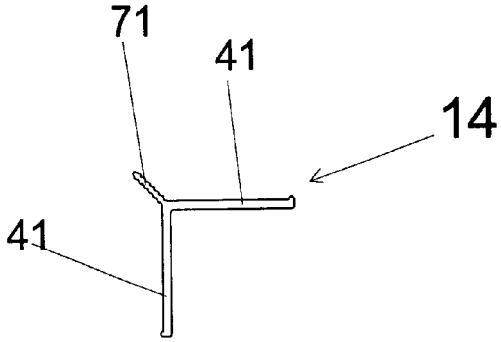

Progressing on to FIG. 3*b* which shows a section view of an inside corner cover (14) that also includes two cover plates (41) arranged in substantially perpendicular respective orientation and also defining a right angle. Inside corner cover (14) includes a retainer insert (71), said retainer insert protruding outward along a line bisecting the angle formed by corner plates (41). Said insert (71) designed to fit between profile rails (3) of adjacent panel assemblies placed in substantially perpendicular orientation.

Figure 3C:
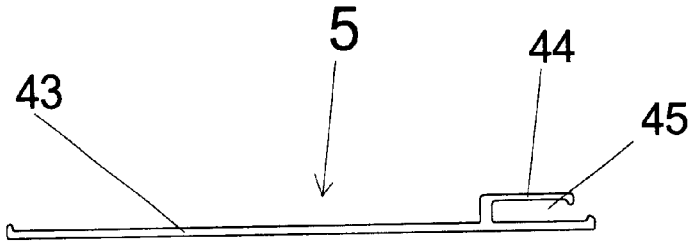

FIG. 3*c* shows a cross section view of base plate (5) that includes coping plate member (43), retention rail (44) attached to said coping plate member (43) on one end and arranged substantially parallel thereto, thus defining an insert space (45) therebetween.

Figure 3D:
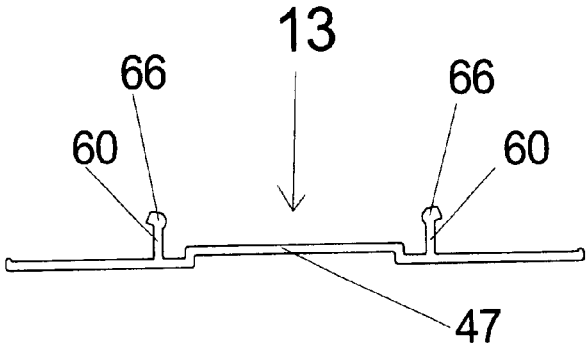

Further, FIG. 3*d* shows a cross section view of joint cover plate (13) including a substantially flat face plate member (47), said face plate member (47) have two inserts (60) attached substantially perpendicular thereto at points approximately equidistant between face plate member ends and centers. Said inserts (60) each including a retainer (66) on the end opposite face plate member (47).

One of many advantages of the subject invention is a standard attachment means for attaching many of the peripheral components to the profile rail (3). Said standard attachment means, comprised primarily of standard clip connector (50) and standard clip receiver (46) described supra, provides for design simplicity allowing a minimal number of individual components. Limited components provides for a system that is cost effective to manufacture and relatively easy to learn and install.

Though the partition system disclosed herein includes a number of individual components, the system is designed around a compressed straw core panel (1). Said straw core panel is composed of highly compressed straw, usually wheat, rice, oat, or other recovered agricultural straw. Typically, panels are made through a dry extrusion process wherein straw is compressed into a substantially flat continuous web, normally between 1" and 3" thick and between 30" and 65" wide. The continuous web is lined on all sides by paper or paperboard. The continuous web is then cut into rectangular panels of various lengths.

These straw core panels possess many unique properties highly suitable for partition system applications. For example, finished panels can easily be textured, painted, retextured, repainted, or covered with a variety of wall covering materials such as wallpaper or fabric comparably to conventional gypsum board walls or partitions.

Like conventional gypsum board or wood-based walls or partitions, straw core panels are suitable for accepting nails, tacks, screws or the like for hanging pictures, plaques, etc. Importantly, the preferred straw core panels possess nail pull properties superior to conventional gypsum board walls, thus providing a superior mounting surface. Additionally, straw core panels are typically thicker and stronger, thus providing nails, screws, or the like driven therein support more weight than if driven into conventional gypsum board.

In the preferred embodiment, compressed straw panels manufactured by Affordable Business Systems (ABS) of Whitewright, Tex. are used. The ABS panels posses favorable structural and acoustic properties that provide a superior embodiment of subject invention. For example, these panels possess a structural rack load strength of 710 lbs., and a structural transverse load rating exceeding 105 lbs. according to ASTM E72-98. The ABS panels further provide a sound transmission coefficient (STC) of 29 according to ASTM E90-99, and a noise reduction coefficient (NRC) of 0.50 according to ASTM C423-00. The ABS panel also provide thermal insulating properties with an 1.481 R value according to ASTM C518-98. Importantly, the ABS panel has a nail pull rating of 97.8 lbs. according to ASTM C473-00. Additionally, the ABS straw core panels are highly fire resistant as indicated by the a Class A flame spread rating according to ASTM E-84-00a.

It should also be noted that the preferred embodiment disclosed herein includes glass panels (2), but alternate embodiments may include plexiglass, plastic, opaque materials or any other substantially solid material possessing proper dimensions to fit the components and subcomponents disclosed herein. Substantially transparent panels, non-transparent panels, or panels with varying degrees of opacity may be utilized.

Figure 5:
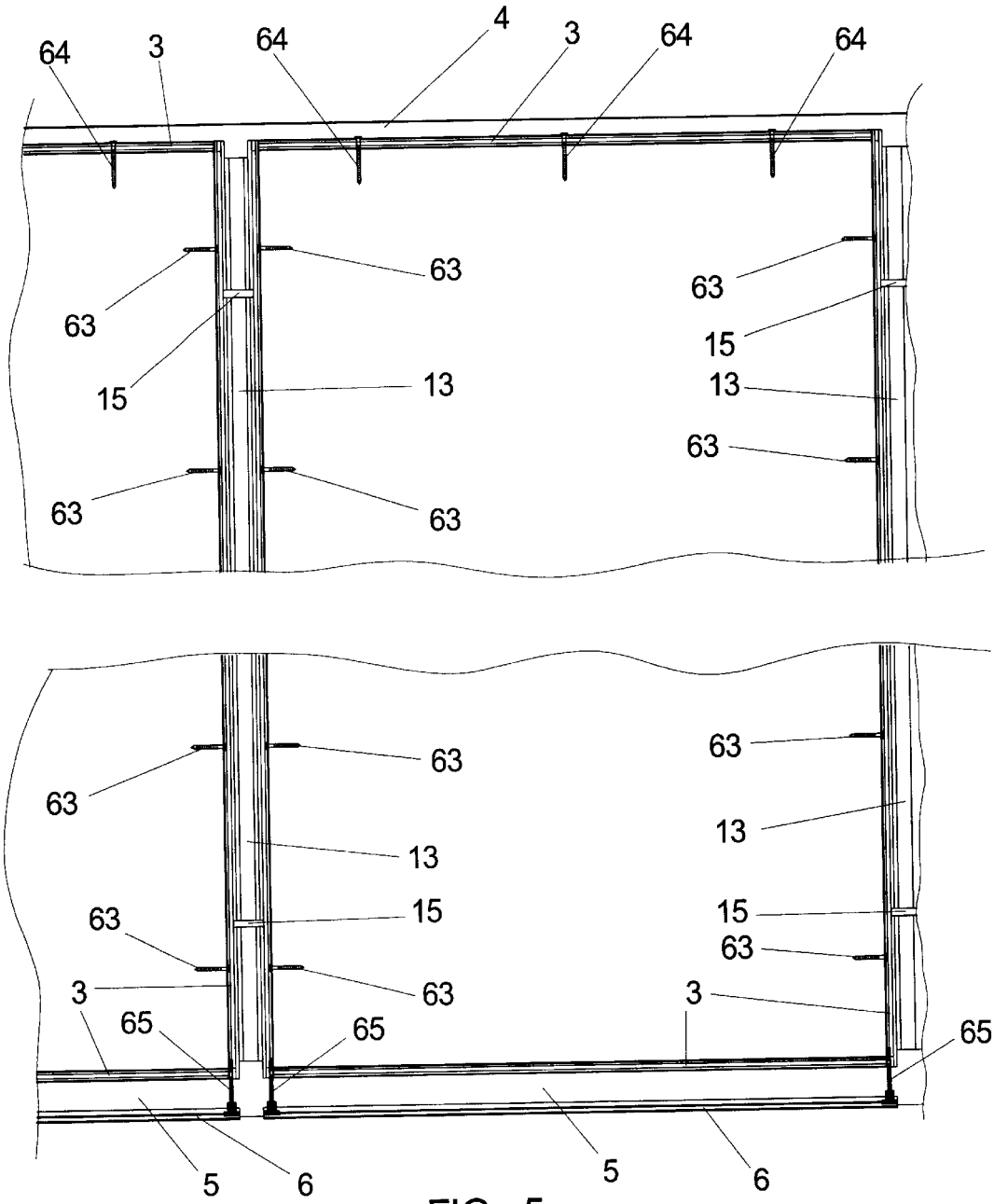
FIG. 5 shows vertical sectional view of a floor to ceiling multi-panel partition that includes compressed straw core panels.

Referring now to FIG. 5 that shows a typical configuration of a panel in a floor to ceiling application. FIG. 5 is a vertical cutaway view showing two straw core panels (1) in typical side by side, substantially planar orientation. Each panel is bordered on all is four edges by profile rail (3). It is implied in FIG. 5 that each floor rail (6) rests on the floor and ceiling crown (4) is in flush contact with the ceiling. Alternatively, a crown rail (22) may be substituted for ceiling crown (4) for a partial height application. Importantly, when attached to either the top or bottom edge of straw core panel (1), profile rail (3) should be situated with the open channel (28) facing the panel to allow interface between standard clip receivers (46) and various components that include a standard clip connector (50). Similarly, when attached to the side of straw core panel (1), profile rail (3) should be situated with the open channel facing away from the panel to allow interface between the open channel (28) and components such as 'T' connectors (15 & 18).

In the preferred embodiment, top profile rails (3) are attached to straw core panels (1) by means of long lag screws (64). It is recommended that long lag screws be spaced no more that 16" apart. In a preferred embodiment, ¼"×3" lag screws are used. Prior to insertion, properly placed and sized holes are drilled through each profile rail (3).

Similarly, side profile rails (3) are attached to straw core panels (1) by means of short lag screws (63). It is recommended that short lag screws be spaced no more than 20" apart. In a preferred embodiment, ¼"×2½" lag screws are used. Prior to insertion, properly placed and sized holes are drilled through profile rail (3).

In alternative embodiments, profile rails (3) may be attached to edges of straw core panels (1) by means of nails, anchors, adhesives or other means. The most important objective is a rigid attachment between profile rails (3) and the edge of the panel held therein.

Figure 6A:
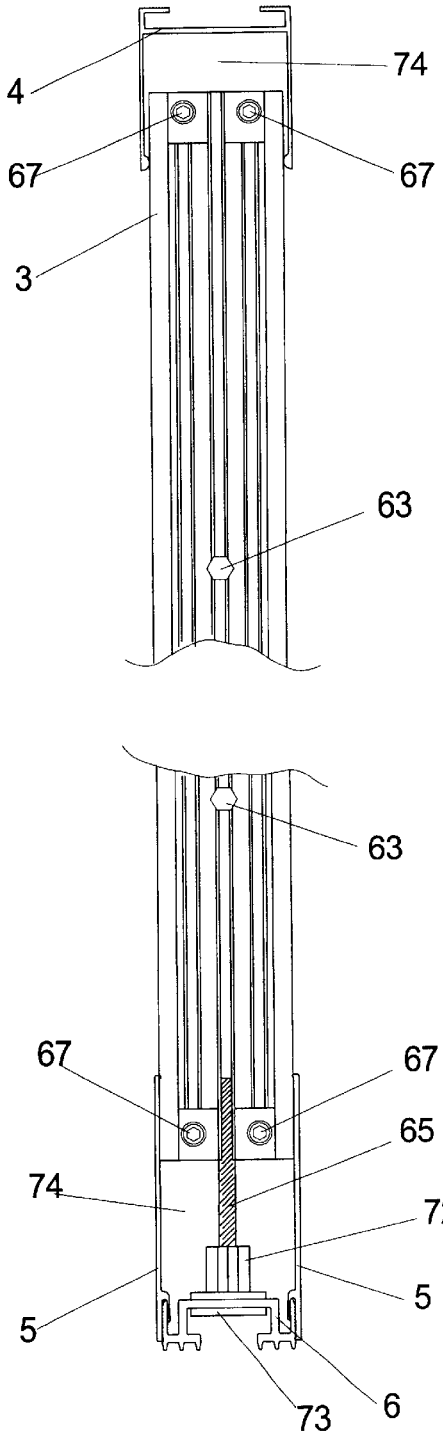
FIGS. 6*a* and 6*b* show an end view of a vertical floor to ceiling partition and a vertical sectional end view of a vertical partition, with both views including compressed straw core panels.

Referring now to FIG. 6*a*, it is shown that profile rail (3) is attached at the bottom to base leg assembly (11). Each base leg (11) is comprised of a threaded shaft (65), foot piece (73) and adjustment nut (72). Threaded shaft (65) is movably disposed within base leg receiver (62). Base leg receiver (62) being an integral part of profile rail (3). The distance between profile rail (3) and foot piece (69) can be changed by rotating threaded shaft (68) and effectively screwing the shaft into or out of base leg receiver (62). Further, finer height adjustments can be made by rotating adjustment nut (72) and allowing foot piece (73) to drop with respect to floor rail (6). It can be seen that limited travel is available between foot piece (73) and floor rail (6), thus gross adjustment are made at the threaded shaft (65) base leg receiver (62) connection.

Figure 6B:
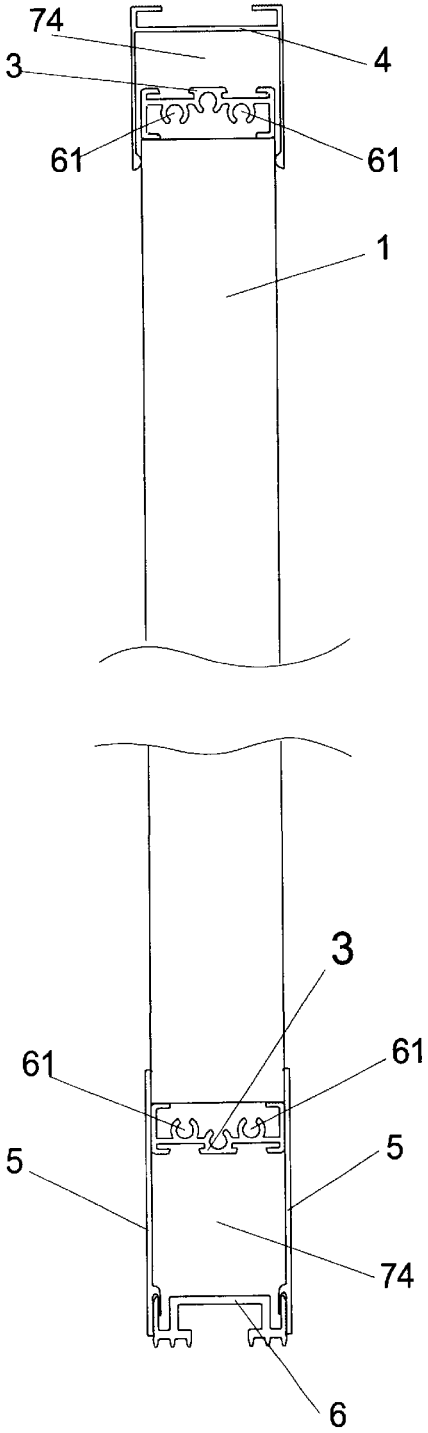

With continuing reference to FIG. 6*a*, it can be further seen that both the top and bottom of side profile rail (3) includes a pair of cap screws (67). Each cap screw is placed through a concentric hole in side profile rail (3) and is fixably disposed within a concentrically situated cap screw receivers (61) on top and bottom profile rails. Said cap screw receivers (61) are shown in FIG. 6*b*. Importantly. The cap screw connections at each corner effectively provide for a rigid profile rail frame around the straw core panel enclosed therein.

Referring back to FIG. 5, it can be seen the lower end of each base leg assembly (65) is attached to a floor rail (6). Each floor rail (6) is situated to lie flat on the floor below. As can be seen in FIG. 6*a*, the base leg assembly (65) is attached to floor rail (6) by means of a rigid connection between internal frame (40) and foot piece (69).

Referring back to FIGS. 6*a* and 6*b*, the panel assemblies are covered by ceiling crown (4). In a floor to ceiling partition application, the ceiling crown contact rails (69) will come into flush contact with an interior ceiling. Alternatively, in partial height partition applications, crown rail (22) will provide a finished covering for the top edge of a panel assembly. The width of both crown rail (4) and ceiling crown (22) is sized to fit over the top edge of a panel assembly such that the lower ends of crown walls (38) continuously push inward against the panel assembly thus providing a snug, secure fit and preclude unwanted displacement. Importantly, properly positioned ceiling crown (4) or crown rail (22) provides a horizontal conduit space (74) running the length of a panel assembly. Said horizontal conduit space (74) provides a convenient enclosure for utility wiring. Conduit space located effectively within a crown piece can be accessed by simply sliding an individual crown piece upward and removing it from the panel assembly.

FIGS. 6*a* and 6*b* also show a horizontal conduit space (74) at the base of the panel assembly as defined by bottom profile rail (3), base plates (5) and floor rail (6). Importantly, bottom conduit space (74) runs the length of an entire finished panel assembly and also provides a convenient enclosure for utility wiring. Further, each base plate (5) is mounted to a mounting rail (34) located on floor rail (6). Each mounting rail (34) fits snugly into insert space (45) of base plate (5), securely holding said base plate (5) in a substantially vertical direction and causing the top edge of coping plate member (43) to push against the panel assembly, thus providing a tight fit. Bottom conduit space (74) can be accessed by sliding base plate (5) upward until mounting rail (34) is no longer held within insert space (45), then removing the individual base plate (5). Each base plate (5) is replaced by simply reversing the process above.

The vertical cutaway view of FIG. 5 also shows double 'T' connectors (15) holding parallel side profile rails (3) together. For better illustration, refer to FIG. 10*c* that shows a horizontal cutaway view of a typical panel/panel joint. As illustrated, double 'T' connector (15) is positioned between two side profile rails (3) and an insert bar (31) is slidably disposed within the open channel (28) of each profile rail (3). Further, the overall length of double 'T' connector (15) provides the proper spacing between opposed retention rail members (59) to allow insertion of insert members (60) of joint cover plate (13) therebetween. Once inserted, joint cover plate (13) is snugly held in place by retainer ends (66) situated just past the ends of retention rail members (59). Although held tightly in place, joint cover plate (13) can be removed and replaced by hand. As also illustrated in FIG. 10*c*, a vertical conduit space (75) is defined by profile rails (3) and joint cover plates (13). Vertical conduit space (75) provides a convenient vertical enclosure for utility wiring and the like.

Figure 7A:
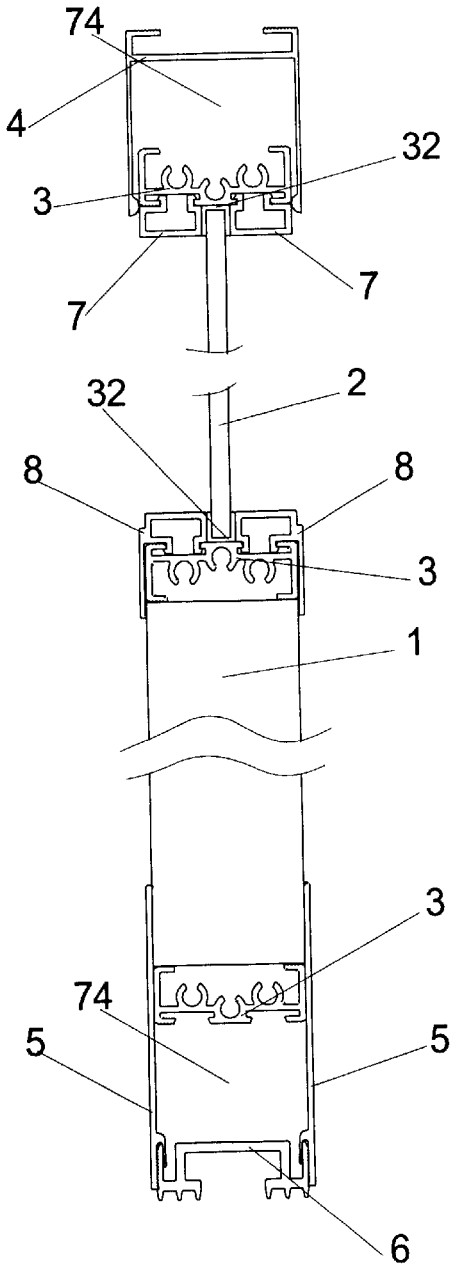
FIGS. 7*a* through 7*c* show vertical sectional views of three alternative configurations of vertical floor to ceiling partitions.

An alternative partition configuration is shown in FIG. 7*a*. In the vertical section view, it can be seen that the partition depicted includes a bottom straw core panel (1) and a top glass panel (2). As shown, the base of glass panel (2) rests within 'U' channel (32). In a preferred embodiment, 'U' channel (32) is made of a resilient material such as rubber or silicone. The base of 'U' channel (32) rests upon profile rail (3). 'U' channel (32) is bordered on each side by a covered window stop (8). Each covered window stop (8) is fixably attached to profile rail (3) by means of clip connector assembly (50) and clip receiver assembly (46) discussed supra. Likewise, the top of glass panel (2) is held within 'U' channel (32) which is securely held on each side by a window stop (7). Each window stop (7) is attached to profile rail (3) by means of clip connector assembly (50) located thereon and a clip receiver assembly (46) located on the profile rail (3) situated above. The entire partition is topped by ceiling crown (4) that rests against a ceiling above. In the configuration depicted in FIG. 7*a*, the bottom of each crown wall (38) push against the bottom of profile rail (3) to provide a secure fit thereto. As can be seen, all configurations shown in FIG. 7 provide both a top and bottom horizontal conduit space (74).

Figure 7B:
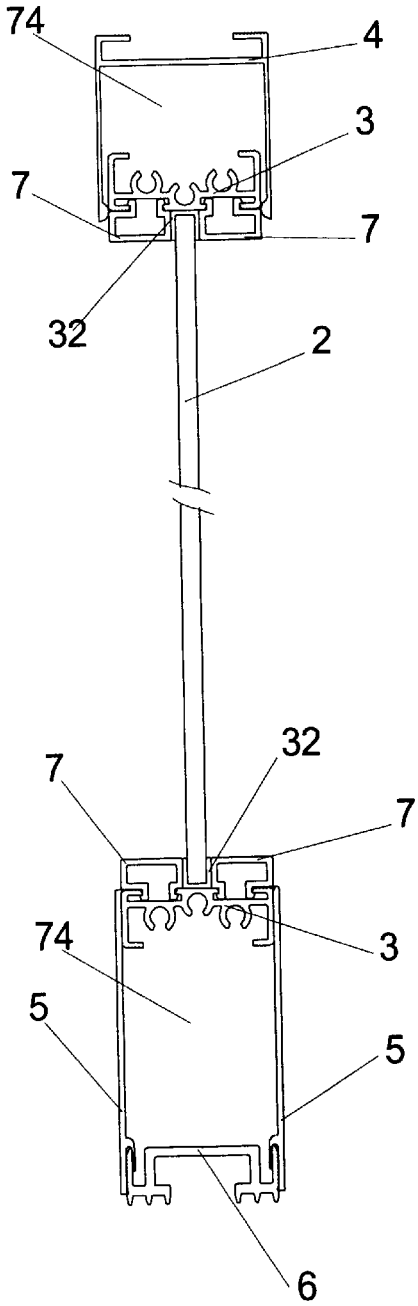

An alternative partition configuration that does not include a straw core panel is shown in FIG. 7*b*. Glass panel (2) spans the entire vertical distance between bottom profile rail (3) and the top profile rail (3). In this configuration, window stops (7) are used to enclose the 'U' channel (32) at both the top and bottom of glass panel (2). Importantly, in this configuration, the distance between floor rail (6) and bottom profile rail (3) is fixed such that the top ends of coping plates (5) are aligned with the join line between bottom profile rail (3) and window stops (7). The required distance can be "dialed in" by rotating the threaded shaft (38) of base leg (65) (not shown).

Figure 7C:
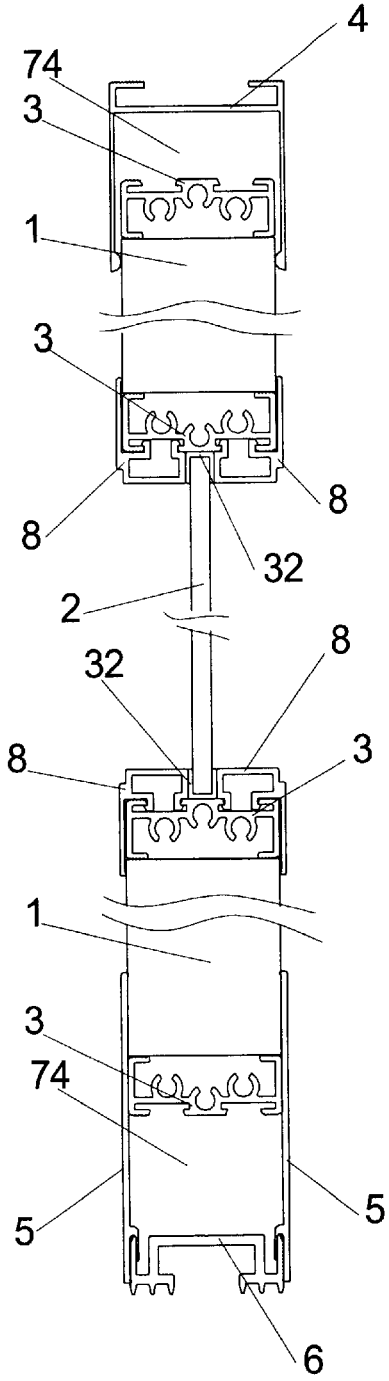

A third alternative partition configuration is shown in FIG. 7*c*, wherein a glass panel (2) is situated between straw core panels (1) on both the top and bottom sides. As illustrated, straw core panels are held between profile rails (3) positioned with profile rail channels (28) facing the straw core panels (1). Glass panel (2) is held between profile rails (3) with profile rail channels (28) facing away. Glass panel (2) is enclosed on the top and bottom sides by 'U' channels (32) with each 'U' channel (32) held between covered window stops (8). As before covered window stops (8) and profile rails (3) are connected by means of clip connector assemblies (50) and clip receiver assemblies (46). Another advantage to the partition system disclosed herein is the inclusion of doors as an integral part of the overall system. In the preferred embodiment, doors are made from properly sized compressed straw core panels.

Figure 8A:
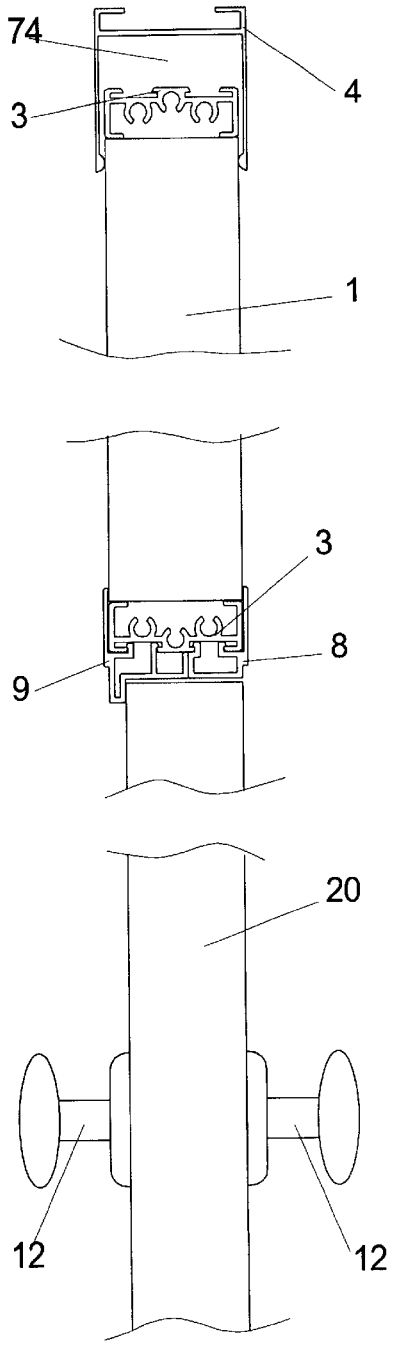
FIGS. 8*a* and 8*b* show vertical sectional views of two alternative configurations of vertical partitions both including door members.
Figure 8B:
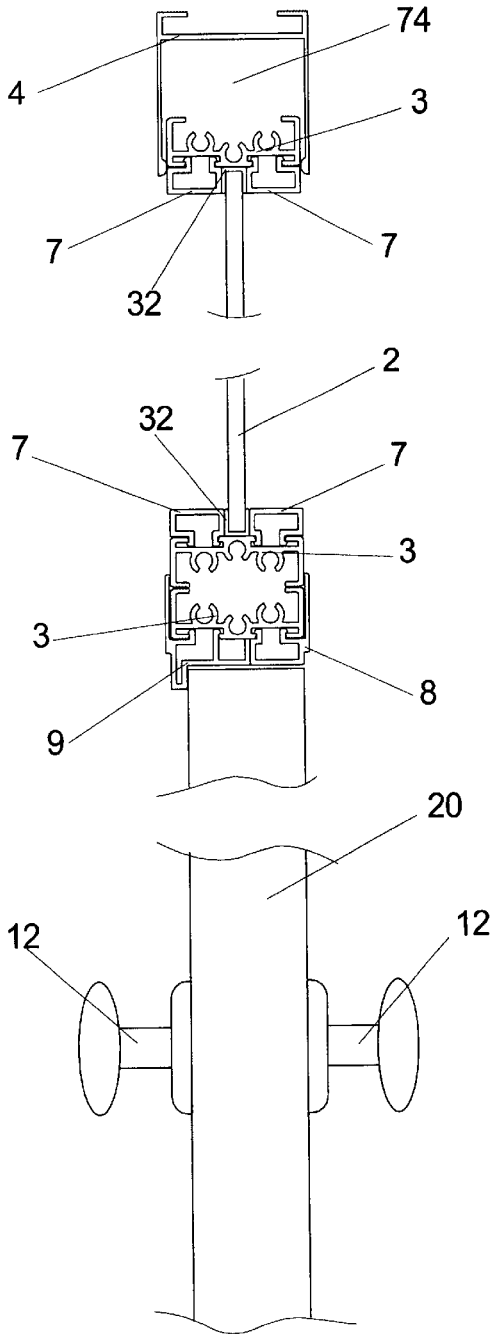

Referring now to FIG. 8*a*, a vertical section view of a partition that includes a door is shown. Door panel (20) is generally situated below a straw core panel (1). At the base of straw core panel (1) is profile rail (3) with profile rail channel (28) facing straw core panel (1). Attached to the bottom of bottom profile rail (3) are covered window stop (8) and horizontal door rail (9). Both covered window stop (8) and horizontal door rail are attached to profile rail (3) by means of clip connector (50) and clip receiver (46).

Figure 10A:
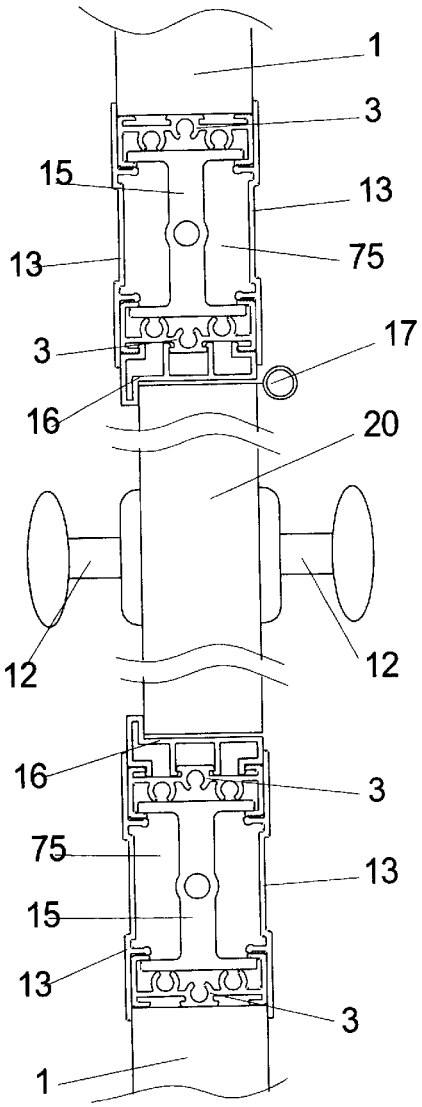
Figure 10B:
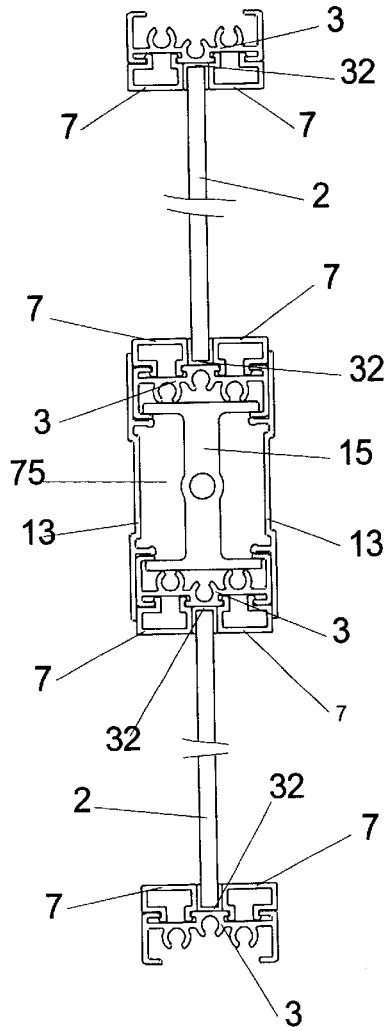
Figure 10C:
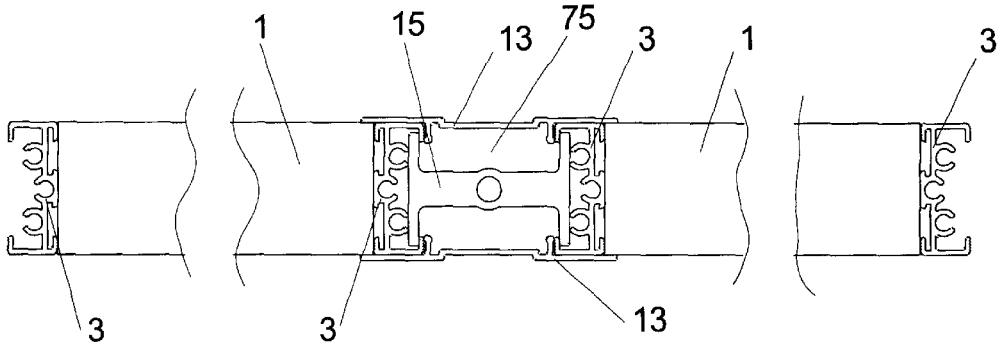

For clarification, a horizontal section view of the same door detailed in FIG. 8*a* is shown in FIG. 10*a*. Door panel (20) is situated between straw core panels (1) located on each lateral side. Each vertical side edge of door panel (20) is adjacent a vertical door rail (16) with each attached to a vertical profile rail situated alongside. Each vertical door rail (16) is attached to a profile rail (3) by means of a pair of clip connectors (50) and clip receivers (46) as shown. Each profile rail (3) attached to a vertical door rail (16) is slidably attached, opposite vertical door rail (16), to a plurality of double 'T' connectors (15). As previously described, a slidable connection between profile rail (3) and double 'T' connector (15) is accomplished as insert bar member (31) is held within profile rail channel (28) by means of retention rail members (59). Continuing, each double 'T' connector (15) is then attached to a laterally positioned vertical profile rail (3) that is subsequently attached to a laterally positioned straw core panel (1). The vertical conduits (72) about double 'T' connectors (15) are covered on remaining open sides by joint cover plates (13). In the closed position, door panel (73) may lightly contact door stop members (57) along each vertical edge. A plurality of conventional door hinges can be attached on either side, such that the door panel (73) opens away from door stop members (57). Though shown on several drawings disclosed herein, door hardware, ie., knobs, locks, jambs, hinges, etc., can be conventional hardware and is not specific to this disclosure.

Figure 9A:
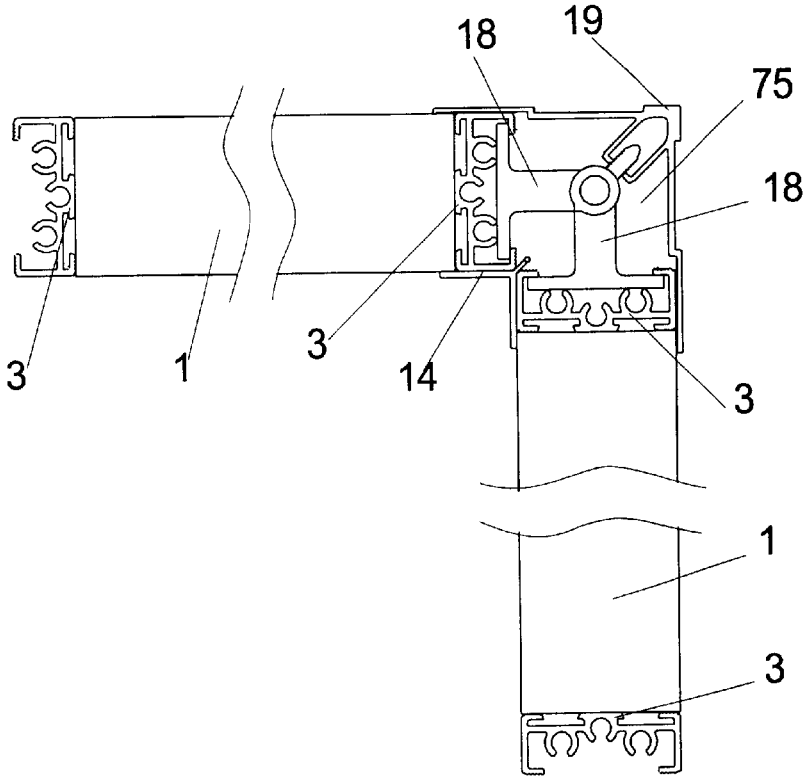
FIGS. 9*a* and 9*b* show a horizontal sectional views of a corner 'L' connection and a 'T' intersection both including straw core panels.

Referring now to FIGS. 9(*a* & *b*) that shows horizontal section views of panel to panel connections. Referring first to FIG. 9*a*, a two panel corner connection is shown. As seen, the vertical profile rails (3) facing the corner connection are each slidably attached to single 'T' connectors (18). Each insert bar member (31) is held within profile rail channel (28) by means of retention rail members (59) to provide a slidable attachment. Single 'T' connectors are then in perpendicular relative positions allowing the concentric alignment of pin receivers (27) and insertion of a connector pin (21) (not shown) there through. When straw core panels (1) and profile rails (3) are set in a substantially perpendicular relative position, a narrow gap between the inside corners of profile rails (3) will be present. This gap is suitable for accepting the retainer insert (71) of inside corner cover (14). Further, outside corner cover (19) can be placed over the outside corner of the connection as shown and held in place by the interaction between retainer clips (35) and retention finger (68) previously discussed. Though not illustrated, the top of the corner connection illustrated should be covered by two ceiling crown pieces (4) or crown rails (22) (neither is shown), and each should be mitered at substantially 45° angles and placed over each panel per previous discussion.

Figure 9B:
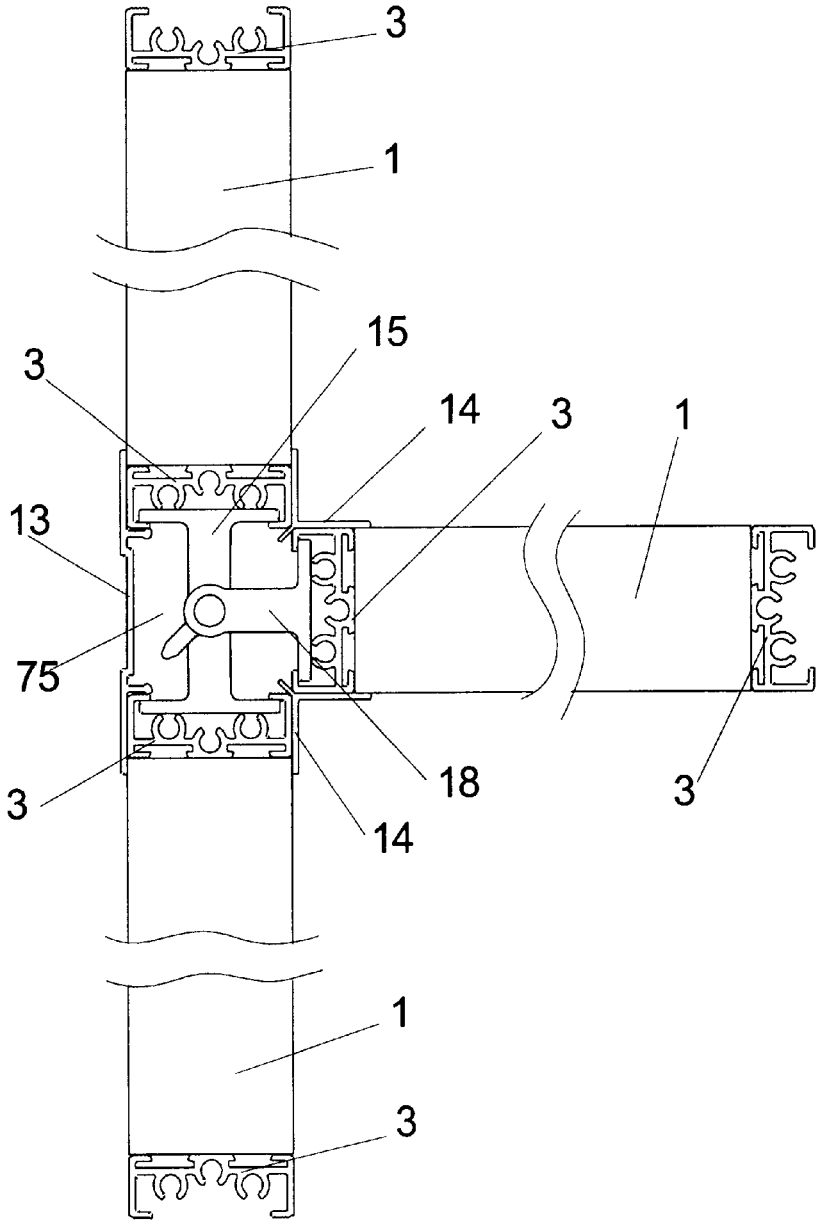

FIG. 9*b* shows a horizontal section view of a typical three panel connection with two panels in substantially planar alignment and a third panel in substantially perpendicular position thereto. Each straw core panel (1) is attached to a profile rail (3) with profile rail channel (28) facing toward the joint area. The straw core panels (1) and respective profile rails (3) in planar alignment are each attached to opposite ends of a double 'T' connector (15) with insert bar member (31) slidably disposed within each profile rail channel (28). The straw core panel (1) and respective profile rail (3) in perpendicular alignment is attached to a single 'T' connector (18) with insert bar member (31) slidably disposed within profile rail channel (28). As illustrated, when the third panel is placed in substantially perpendicular alignment to the planar panels, the pin receivers (27) on double 'T' connector (15) and single 'T' connector (18) can be moved into concentric alignment to accept a connector pin (21) (not shown). Further, inside corner covers (14) should be placed over both inside corners with retainer insert members (71) positioned between profile rails (3). Joint cover plate (13) should be placed over the joint area opposite the perpendicular panel. Joint cover plate will be held in place by interaction between profile rails (3), insert (60) and retainer (66) as shown.

Importantly, each connection provides a vertical conduit space (75) for routing utility wiring and the like.

For a final overview, FIG. 11 contains an exploded view of a portion of a typical assembly. As can be seen, the assembly includes two fall size straw core panels (1) and one partial sized straw core panel located below glass panel (2). Additionally, a door panel (20) is shown. Miscellaneous system components as previously detailed herein are also shown. Of note, FIG. 11 shows optional insulating strips (76) that can be placed within horizontal conduit space (74) or vertical conduit space (75) as needed for added acoustical and/or thermal insulation.

Those skilled in the art will recognize that certain variations or alternative embodiments are easily accomplished with the invention disclosed herein. For example, the system of individual components can easily be used with core panels made from alternative materials such as solid wood, laminated plywood, particle board, oriented strand board, or various composite materials including but not limited to fiberglass, plastics, plexiglass, ceramics, masonry, or combinations thereof. Further, alternative materials may well be used in the various component parts without deviating from the invention claimed herein.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only, and changes may be made in the detail, especially in matters of shape, size, and arrangement of the parts within the principles of the inventions to the full extent indicated by the broad meaning of the terms of the attached claims.

The restrictive description and drawings of the specific examples herein do not point out what an infringement of this patent would be, but are to provide at least one explanation of how to use and make the inventions. The limits of the inventions and the bounds of the patent protection are measured by and defined in the following claims.

What is claimed is:

1. An assembly for positioning and arranging one or more rigid compressed straw panels to divide or partition interior building space, said panels being comprised of compressed straw or other cellulose-based fibers arranged in a matrix and having a substantially rectangular shape with a front and rear face, said faces situated in substantially parallel planes and further having a top edge, a bottom edge, a right edge and a left edge with four corners formed at the junctures between said edges, said system comprising:

a rigid perimeter frame disposable about the edges of said panel, said frame especially adapted to receive and securely hold a compressed straw panel, said perimeter frame being substantially flush with said front and rear face of said straw panel and having a leg reception means disposed substantially near each corner;

first and second base legs, said base legs each having a top and bottom end said top end suitable for slidable attachment to a said perimeter frame such that interference with and penetration into said straw panel is prohibited;

a floor member, said floor member having a generally elongated shape and having a first and second end, said floor member suitable for attachment to said bottom end of said base legs; and a plurality of panel connector means, said panel connector means each having at least one end suitable for slidable attachment to said perimeter frame, and each further having a joining hole suitable for joining with other connector means.

2. The assembly of claim 1, wherein said perimeter frame further comprises:

a top profile rail member located along and fixably attached to top edge of said straw panel, said top profile rail member having a first and second end and being substantially the same length and width as said top panel edge;

a bottom profile rail member located along and fixably attached to bottom edge of said straw panel, said bottom profile rail member having a first and second end and being substantially the same length and width as said bottom panel edge;

a right profile rail member located along and fixably attached to right edge of said straw panel, said right profile rail member having a first and second end and being substantially the same length and width as said right panel edge, said right profile member further being rigidly attached at each end to said top and bottom profile rail members respectively; and a left profile rail member located along and fixably attached to left edge of said straw panel, said left profile rail member having a first and second end and being substantially the same length and width as said left panel edge, said right profile member further being rigidly attached at each end to said top and bottom profile rail members respectively.

3. The assembly of claim 2, further comprising:

a crown facade member, said crown facade member having a generally elongated shape with a 'C' shaped cross sectional area defining an internal longitudinal channel, said crown facade suitable for fitting over said top edge of said panel so as to contain a top profile rail member therein; and a base facade member, said base facade member having a generally flat shape with a top and bottom edge, bottom edge suitable for attachment to said floor member to support said base facade member in a substantially vertical plane.

4. The assembly of claim 2, wherein said profile rail members further comprise:

a trough member, said trough member having a first and second end, and further comprised of a base member, said base member having a top and bottom face, and opposed left and right side walls, each side wall attached to said base member so as to form a longitudinal trough between said side members and above top face of said base member, said side members each including an inwardly directed retaining lip located opposite said top face of said base member, said retaining lips situated substantially perpendicular to said base member to further define said longitudinal trough therebetween;

first and second parallel attachment channels, said attachment channels located on bottom face of and oriented substantially parallel to said base of said trough member, said attachment channels each suitable for accepting a properly sized two pronged connector therein; and screw receiver means, said screw receiver means located within and oriented coaxial with longitudinal trough of said trough member, said screw receiver means suitable for releasably accepting a properly sized threaded shaft therein.

5. The assembly of claim 4, further comprising:

a first retainer rail, said retainer rail having a first and second end and a substantially rectangular cross section defined by a top side, bottom side, first side and second side, said top, bottom, first and second sides containing a longitudinal channel therebetween, said retainer rail further comprising a two-pronged connector means suitable for fixable insertion into said first or second parallel attachment channels of said profile rail member;

a second retainer rail, said retainer rail having a first and second end and a substantially rectangular cross section defined by a top side, bottom side, first side and second side, said top, bottom, first and second sides containing a longitudinal channel therebetween, said retainer rail further comprising a two-pronged connector means suitable for fixable insertion into said first or second parallel attachment channels of said profile rail member;

a planar member, said planar member suitable for insertion between said first and second retainer rails such that a said planar member is releasably engaged therebetween.

6. The assembly of claim 5, wherein said two-pronged connector means further comprises:

a first flexible prong member, said first prong member having a base, an end, an inner face and an outer face, said first prong member further including a retainer cleat, said retainer cleat located on said outer face and adjacent to said end of said first prong member, said first prong member suitable for elastic deflection in the direction of said inner face; and a second flexible prong member, said second prong member having a base, an end, an inner face and an outer face, wherein inner face of said second prong member faces and is substantially parallel to inner face of said first prong member, said second prong member further including a retainer cleat, said retainer cleat located on said outer face and adjacent to said end of said second prong member, said second prong member suitable for elastic deflection in the direction of said inner face.

7. The assembly of claim 6, wherein said parallel attachment channel each further comprises:

first and second parallel finger members, said parallel finger members each having a base and an end, said base of each finger members attached to bottom face of said trough member, said end of each finger member biased inward so as to define a first and second space between said ends and said bottom face of said trough member, said first and second space each suitable for accepting a retainer cleat of either said first and second flexible prong member.

8. The assembly of claim 7, wherein said panel connector means further comprises:

at least one insert bar member, said insert bar member sized to slidably insert within said longitudinal trough of said trough member such that said insert bar member is slidably retained within said longitudinal trough by said retaining lips;

at least one spine member, said spine member having a first and second end, said first end rigidly attached to said insert bar member; and a hole member, said hole member located through second end of said spine member, said hole member having an axis substantially parallel to said longitudinal trough when said insert bar member is disposed within said longitudinal trough.

9. A system for positioning and arranging one or more rigid compressed straw panels to divide or partition interior building space, said panels being comprised of compressed straw or other cellulose-based fibers arranged in a matrix and having a substantially rectangular shape with a front and rear face, said faces situated in substantially parallel planes and further having a top edge, a bottom edge, a right edge and a left edge with four corners formed at the junctures between said edges, said system comprising:

a plurality of panel assemblies, each panel assembly including a straw panel and a rigid perimeter frame disposable about the edges of said panel, said frame especially adapted to receive and securely hold a compressed straw panel, sized to be substantially flush with said front and rear face of said compressed straw panel, and having a leg reception means disposed substantially near each corner;

a plurality of base legs, each base leg having a top and bottom end, said top end slidably attached to a said leg reception means of said perimeter frame;

a plurality of floor members, each floor member having a generally elongated shape and having a first and second end, each said floor member suitable for attachment to said bottom ends of a pair of said base legs;

a plurality of single panel connector means, said single panel connector means each having one end suitable for slidable attachment to said perimeter frame, and each further having a joining hole suitable for joining with other connector means, said single connector means further suitable for perpendicularly attaching at least two panel assemblies together in non-parallel relative arrangement; and a plurality of double panel connector means, said double panel connector means each having two opposed ends, each opposed end suitable for slidable attachment to said perimeter frame, each double connector means further having a joining hole suitable for joining with other connector means, said joining hole located substantially equidistant between said opposed ends, double panel connector means suitable for attaching two panel assemblies together in a substantially planar arrangement.

10. The system of claim 9, further comprising:

a plurality of crown facade members, each said crown facade member having a generally elongated shape with a 'C' shaped cross sectional area defining an internal longitudinal channel, said crown facade members suitable for fitting over said top edge of said panel assemblies so as to contain a portion of said perimeter frame therein; and a plurality of base facade members, each said base facade member having a generally flat shape with a top and bottom edge, bottom edge suitable for attachment to a said floor member to support said base facade member in a substantially vertical plane.

11. The system of claim 10, wherein each said rigid perimeter frame further comprises:

a top profile rail member located along and fixably attached to top edge of said straw panel, said top profile rail member having a first and second end and being substantially the same length as said top panel edge;

a bottom profile rail member located along and fixably attached to bottom edge of said straw panel, said bottom profile rail member having a first and second end and being substantially the same length as said bottom panel edge;

a right profile rail member located along and fixably attached to right edge of said straw panel, said right profile rail member having a first and second end and being substantially the same length as said right panel edge, said right profile member further being rigidly attached at each end to said top and bottom profile rail members respectively; and a left profile rail member located along and fixably attached to left edge of said straw panel, said left profile rail member having a first and second end and being substantially the same length as said left panel edge, said right profile member further being rigidly attached at each end to said top and bottom profile rail members respectively.

12. The system of claim 11, wherein each profile rail member further comprises:

a trough member, said trough member having a first and second end, and further comprised of a base member, said base member having a top and bottom face, and opposed left and right side walls, each side wall attached to said base member so as to form a longitudinal trough between said side members and above top face of said base member, said side members each including an inwardly directed retaining lip located opposite said top face of said base member, said retaining lips situated substantially perpendicular to said base member to further define said longitudinal trough therebetween;

first and second parallel channels, said parallel channels located on bottom face of and oriented substantially parallel to said base of said trough member, said parallel channels suitable for accepting a properly sized two pronged connector therein; and screw receiver means, said screw receiver means located within and oriented coaxial with longitudinal trough of said trough member, said screw receiver means suitable for releasably accepting a properly sized threaded shaft therein.

13. The system of claim 12, further comprising:

a plurality of retainer rails, each said retainer rail having a first and second end and a substantially rectangular cross section defined by a top side, bottom side, first side and second side, said top, bottom, first and second sides containing a longitudinal channel therebetween, each said retainer rail further comprising a two-pronged connector means suitable for fixable insertion into a said parallel channel on a said profile rail member.

14. The system of claim 13, wherein said two-pronged connector means further comprises:

a first flexible prong member, said first prong member having a base, an end, an inner face and an outer face, said first prong member further including a retainer cleat, said retainer cleat located on said outer face and adjacent to said end of said first prong member, said first prong member suitable for elastic deflection in the direction of said inner face; and a second flexible prong member, said second prong member having a base, an end, an inner face and an outer face, wherein inner face of said second prong member faces and is substantially parallel to inner face of said first prong member, said second prong member further including a retainer cleat, said retainer cleat located on said outer face and adjacent to said end of said second prong member, said second prong member suitable for elastic deflection in the direction of said inner face.

15. The system of claim 14, further comprising:

at least one planar member, each said planar member suitable for insertion between a pair of said retainer rails when said retainer rails are connected to a single profile rail via said parallel channels, said planar member releasably engaged therebetween.

16. The system of claim 15, wherein each said parallel channel further comprises:

first and second parallel finger members, said parallel finger members each having a base and an end, said base of each finger members attached to bottom face of said trough member, said end of each finger member biased inward so as to define a first and second space between said ends and said bottom face of said trough member, said first and second space each suitable for accepting a retainer cleat of either said first and second flexible prong member.

17. The system of claim 16, wherein each single panel connector means further comprises:

one insert bar member, said insert bar member sized to slidably insert within said longitudinal trough of said trough member such that said insert bar member is slidably retained within said longitudinal trough by said retaining lips; a spine member, said spine member having a first and second end, said first end rigidly attached to said insert bar member; and a hole member, said hole member located through second end of said spine member, said hole member having an axis substantially parallel to said longitudinal trough when said insert bar member is disposed within said longitudinal trough.

18. The system of claim 16, wherein each double panel connector means further comprises:

first and second opposed insert bar members, each insert bar member sized to slidably insert within said longitudinal trough of said trough member such that said insert bar member is slidably retained within said longitudinal trough by said retaining lips;

a spine member, said spine member having a first end connected to said first insert bar member, said spine member having a second end connected to said second insert bar member; and a hole member, said hole member located through said spine member at a point substantially equidistant between said first and second insert bar members, said hole member further having an axis substantially parallel to said longitudinal trough of a said profile rail when first and second inserts are slidably attached to two substantially planar panel assemblies.

* * * * *